United States Patent [19]

Kocher et al.

[11] Patent Number: 4,704,069

[45] Date of Patent: Nov. 3, 1987

[54] METHOD FOR OPERATING DUAL SLIDE VALVE ROTARY GAS COMPRESSOR

[75] Inventors: Erich J. Kocher, Milwaukee; Paul G. Szymaszek, Waukesha, both of Wis.

[73] Assignee: Vilter Manufacturing Corporation, Milwaukee, Wis.

[21] Appl. No.: 908,016

[22] Filed: Sep. 16, 1986

[51] Int. Cl.[4] ..... F04B 49/02; F04B 49/00; F04C 18/16; F04C 18/20

[52] U.S. Cl. ..... 417/53; 417/299; 417/310; 418/195; 418/201

[58] Field of Search ..... 62/510, 228.5, 196.3; 417/53, 295, 279, 299, 281, 310, 440; 418/195, 201

[56] References Cited

U.S. PATENT DOCUMENTS

| | | | |
|---|---|---|---|
| 4,583,373 | 4/1986 | Shaw | 62/196.3 |
| 4,597,726 | 7/1986 | Soderlund | 418/201 |
| 4,611,976 | 9/1986 | Shibbye | 418/201 |

*Primary Examiner*—William L. Freeh

*Attorney, Agent, or Firm*—James E. Nilles; Thomas F. Kirby

[57] ABSTRACT

A method is disclosed for operating a large motor-driven refrigeration gas compressor which has independently movable suction and discharge slide valves to prevent undesirable, possibly damaging hydraulic pressure build-up caused by sealing oil remaining in the gas compression chambers during compressor start-up. While the compressor is started and brought up to full speed, the suction slide valve is disposed in fully unloaded position to fully open the gas suction port and the discharge slide valve is disposed in position to fully open the gas discharge port to enable excess oil in the gas compression chambers to exit freely through the compressor gas discharge port before oil pressure build-up can occur. When the compressor is at full speed, the suction slide valve is positioned to maintain a desired gas suction pressure and the discharge slide valve is positioned to equalize gas pressure between the gas compression chambers and the compressor gas discharge port. On shut-down of the compressor both slide valves are returned to their start-up positions.

3 Claims, 10 Drawing Figures

"GAS PRESSURE - VOLUME DIAGRAM"

METHOD FOR OPERATING DUAL SLIDE VALVE ROTARY GAS COMPRESSOR

BACKGROUND OF THE INVENTION

1. Field of Use

This invention relates generally to a method for operating a dual slide valve rotary gas compressor to prevent undesirable compression of oil in the gas compression chambers during compressor start-up.

2. Description of the Prior Art

Rotary gas compressors are used, for example, in refrigeration systems to compress refrigerant gas, such as "Freon", ammonia or the like. One new type of rotary gas compressor employs a housing in which a motor-driven single main rotor having spiral grooves thereon meshes with a pair of gate or star rotors on opposite sides of the rotor to define gas compression chambers. The housing is provided with two gas suction ports (one near each gate rotor) and with two gas discharge ports (one near each gate rotor). Two dual slide valve assemblies are provided on the housing (one assembly near each gate rotor) and each slide valve assembly comprises a suction slide valve and a discharge slide valve for controlling an associated suction port and an associated discharge port, respectively. During operation of the compressor, a small amount of oil is continuously supplied to the compression chambers to provide an oil seal at points where the main rotor meshes with the gate rotors and with the housing to thereby effectively seal the chambers against gas leakage during gas compression. The oil flows out through the discharge ports and is recovered and recirculated. When the compressor is shut down and coasting to rest, excess oil can collect or settle in the compression chambers. When the compressor is restarted, the residual oil in the compression chambers, plus fresh oil entering the compression chambers, must be expelled through the discharge ports.

U.S. Pat. Nos. 4,610,612 and 4,610,613, both issued on Sept. 9, 1986, and both assigned to the same assignee as the present application, disclose the aforedescribed new type of dual-slide valve rotary gas compressor and control means for operating the slide valves.

The electric motors employed to drive rotors in rotary compressors are usually of a type which requires the compressor to be unloaded while being started and brought up to some predetermined normal constant speed. Loading and unloading is accomplished by positioning of slide valves which control admission and discharge of gas into and from the compression chambers.

Some prior art rotary compressors employ a movable single slide valve to control both the suction port and the discharge port simultaneously. Unloading of such a compressor for startup requires that the single slide valve be moved to unloaded position wherein the suction port is fully open and the discharge port is fully closed, except for a small fixed discharge port. Under these port conditions, very little gas compression occurs. However, such closure of the discharge port would interfere with the exit flow of oil in the compression chambers which is being driven therethrough toward the discharge port during start-up. The compressor tries to compress an incompressible fluid (oil), and the hydraulic pressure build-up can be great enough to cause damage to compressor components. The remedies for this are to drain residual oil before start-up to prevent serious hydraulic pressure build-up upon start-up and avoid damage to compressor components. Draining oil before start-up is not a simple task because, in a pressure-equalized compressor system, a gravity drain system must be used. If there is no drain reservoir at a lower elevation than the compressor, substantial design modifications must be made. On the other hand, since the amount of oil present at start-up can vary and cannot be accurately determined, designing or operating a single slide valve to provide an oil flow passage through the discharge port, which is large enough or always open far enough to accommodate oil flow during start-up, is practically impossible and would adversely affect compressor efficiency.

The initial approach used by the present applicant to operate the new type dual slide valve rotary gas compressor and controls disclosed in the aforementioned U.S. Pat. Nos. 4,610,612 and 4,610,613, was based on the teachings of and experience with prior art single slide valve rotary compressors. The prior art teaching was to effect start-up of a compressor while it was fully unloaded, i.e., with the suction port fully open and the discharge port fully closed (except for a relatively small fixed discharge port). Application of the prior art teaching to the new dual slide valve compressor led applicant to dispose the independently movable suction slide valve in fully unloaded position and to dispose the independently movable discharge slide valve in corresponding fully unloaded position, i.e., nominally fully closed, but with a relatively small fixed discharge port, as in prior art single slide valve rotary compressors. Therefore, the control means for the dual slide valves were, designed, constructed, interconnected and operated to achieve this result and performance was generally satisfactory. However, under certain unpredictable operating conditions during start-up, as when a large amount of residual oil accumulates and cannot exit rapidly enough through the oil exit passage, there is rapid oil pressure build-up which is sufficiently high to cause component damage in the compressor. This has occurred, even though the end of the discharge slide valve that cooperates with the discharge port, and the discharge port itself, were designed, constructed and sized in accordance with prior art teachings to provide a passage believed to be of sufficient size to allow for the unrestricted exit of oil when the discharge slide valve was in nominally fully closed position, i.e., conventional fully unloaded position.

Efforts aimed at overcoming this serious problem involved several approaches. First, consideration was given to redesign of the compressor to provide an oil drainage system to entirely eliminate the possibility of oil pressure build-up on start-up. This solution is costly and not available for all compressor installations. Second, consideration was given to redesign of the discharge slide valve and discharge port to provide a larger oil exit passage while the discharge slide valve was nominally closed to mitigate the likelihood of oil pressure build-up during start-up. This solution is costly, still unreliable and introduces problems of inefficiency. Finally, applicant conceived the idea of operating the dual slide valves in a novel and unobvious manner which differed from that initially employed and of adapting the control means to effect such operation by rearranging and changing the sequence of operation of the control means. This method of operation proved to be entirely workable and satisfactory, overcame oil pressure build-up during compressor starting, eliminated the risk of component damage, and involved minimum costs. This method is the subject of the present invention.

SUMMARY OF THE PRESENT INVENTION

This invention relates to a method for operating a dual slide valve rotary gas compressor to prevent undesirable compression of oil in the gas compression chambers during compressor start-up. The method is applicable to a rotary screw type gas compressor which comprises a housing having a cylindrical bore therein, a motor-driven helically grooved single main rotor mounted for rotation in the bore, and a pair of star-shaped gate rotors rotatably mounted in the housing and engageable with the grooves in the main rotor to define a plurality of compression chambers, one chamber at each groove. A suction port admits low pressure uncompressed refrigerant gas to the compression chambers. A discharge port releases high pressure compressed refrigerant gas from the compression chambers. Slide valve means comprising dual slide valve members are provided for regulating both compressor capacity and compressor power input. Control means are provided for independently positioning the dual slide valve members.

In the embodiment disclosed, two dual slide valve assemblies are employed with a single main rotor. These two assemblies are located on opposite sides of the rotor, being spaced 180° apart from each other. Each dual slide valve comprises a suction slide valve member which is slidably positionable to control the extent to which the suction port is open to thereby function as a suction by-pass to control compressor capacity. Each dual slide valve assembly further comprises a discharge slide valve member which is independently slidably positionable to control the position at which the discharge port is open to thereby control the volume ratio and thereby the input power to the compressor. Both slide valve members in each assembly are disposed in side-by-side sliding relationship in a recess in the housing, which recess extends alongside and is in communication with the cylindrical bore. Each slide valve member has a face which is complementary to and confronts the main rotor surface in sliding sealed relationship.

The slide valve members are movable independently of each other by the control means which include separate pistoncylinder type pneumatic actuators and sensing means therefor. The control means operate to position the slide valve members for compressor start-up in accordance with the present invention. The control means are also responsive to the capacity of the compressor and to the volume ratio while the compressor is running and operate the actuators to appropriately position the slide valve members and thereby enable the compressor to operate at a predetermined capacity and a predetermined volume ratio.

The method for operating the independently movable suction and discharge slide valves in accordance with the present invention to prevent undesirable, possibly damaging hydraulic pressure build-up caused by sealing oil remaining in the gas compression chambers during compressor start-up is as follows. While the compressor is started and brought up to full speed, the suction slide valve is disposed by the control means in fully unloaded position to fully open the suction by-pass port and the discharge slide valve is disposed by the control means in position to fully open the gas discharge port to enable excess oil in the gas compression chambers to exit freely through the compressor gas discharge port before oil pressure build-up can occur. When the compressor is at full speed, the suction slide valve is positioned by the control means to maintain a desired gas suction pressure and the discharge slide valve is positioned by the control means to equalize gas pressure between the gas compression chambers and the compressor gas discharge port. On shut-down of the compressor both slide valves are returned to their start-up positions by the control means.

A method in accordance with the invention offers numerous advantages. For example, hydraulic pressure build-up during compressor start-up is completely avoided, as is the risk of damage that can result therefrom. Pressure build-up is avoided simply by means of positioning the dual slide valves and there is no need to drain oil from the compressor prior to start-up or to provide costly and complex means for doing so. The dual slide valves are automatically returned by the control means to proper start-up position at the time the compressor is stopped, thereby ensuring that proper start-up will occur. Other objects and advantages will hereinafter occur.

DRAWINGS

Figure 1:
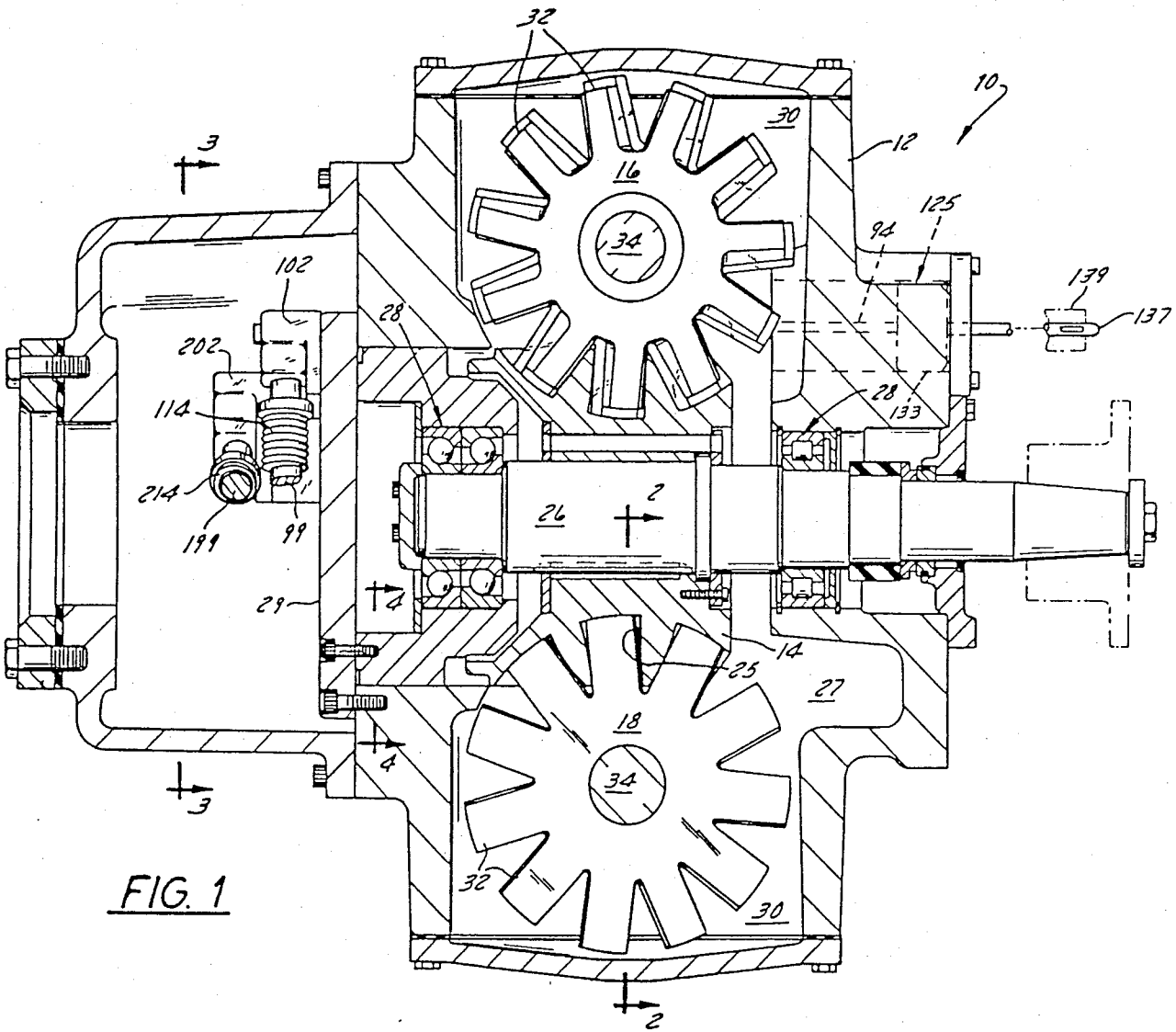
FIG. 1 is a top view, partly in cross-section and with portions broken away, of a rotary gas compressor employing a single screw rotor, a pair of star rotors and having dual slide valves (not visible) to which the method in accordance with the present invention is applicable.
Figure 2:
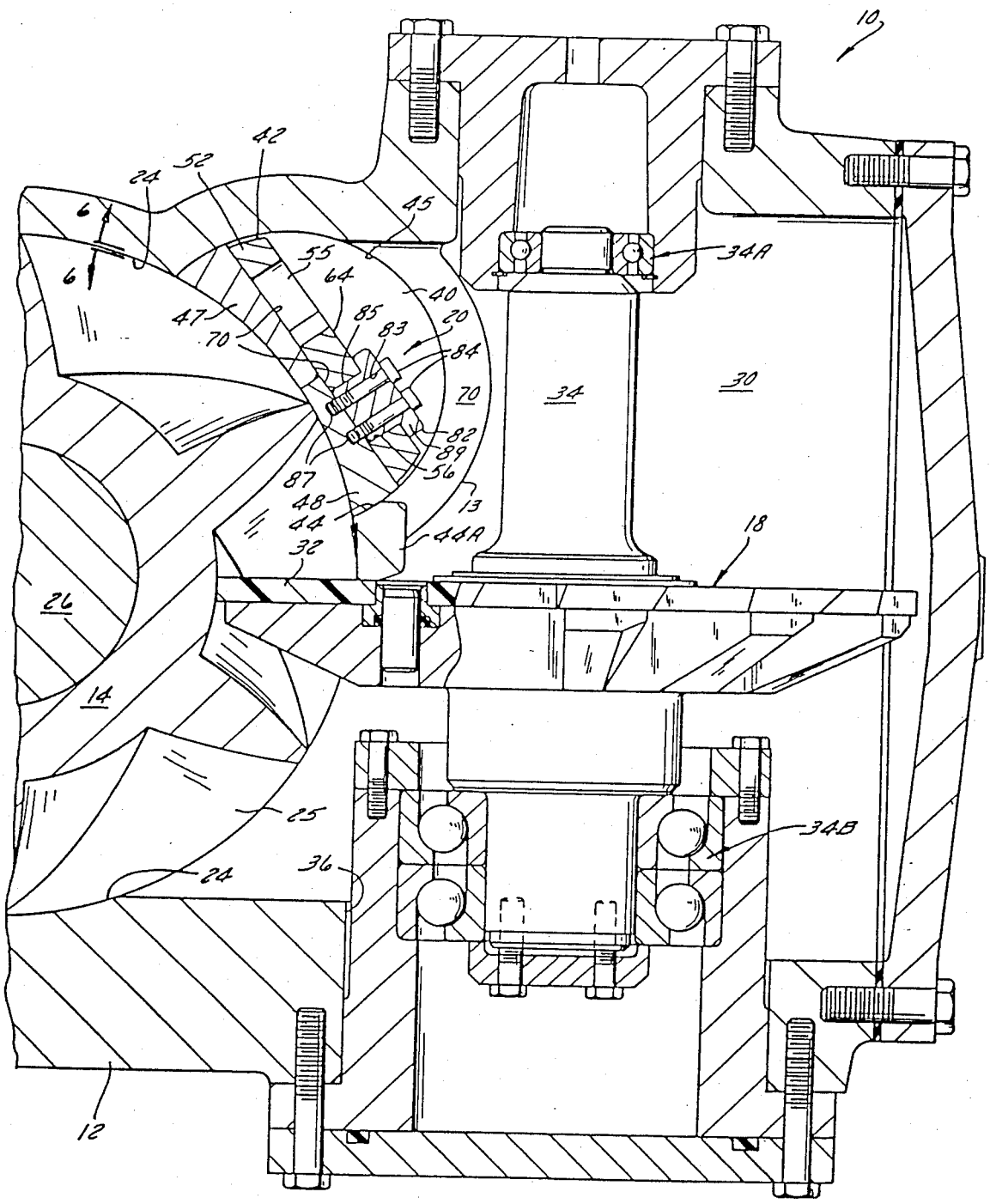
FIG. 2 is an enlarged cross-section view taken on line 2—2 of FIG. 1 and showing one set of dual slide valves in cross-section.
Figure 5:
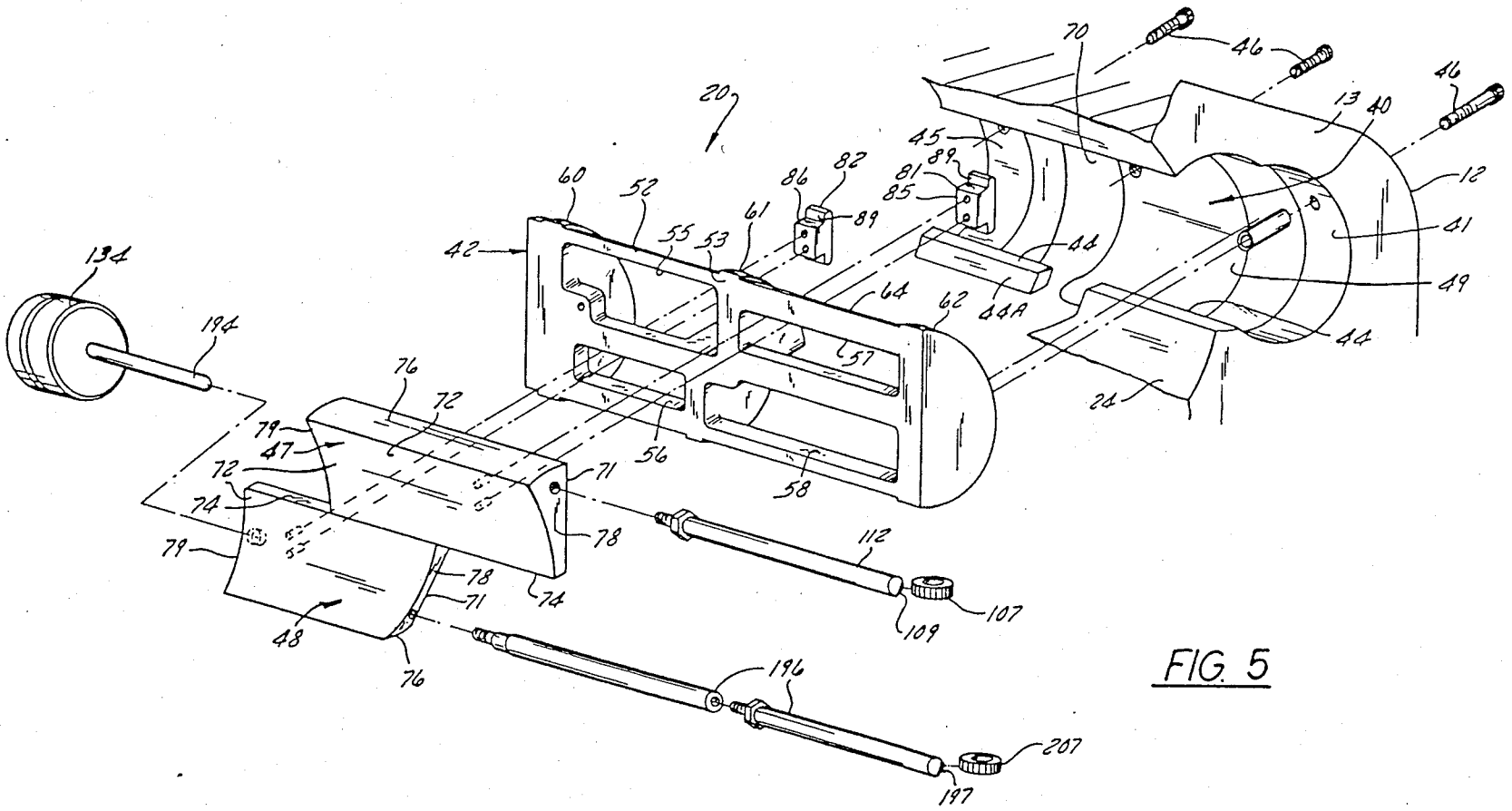
Figure 6:
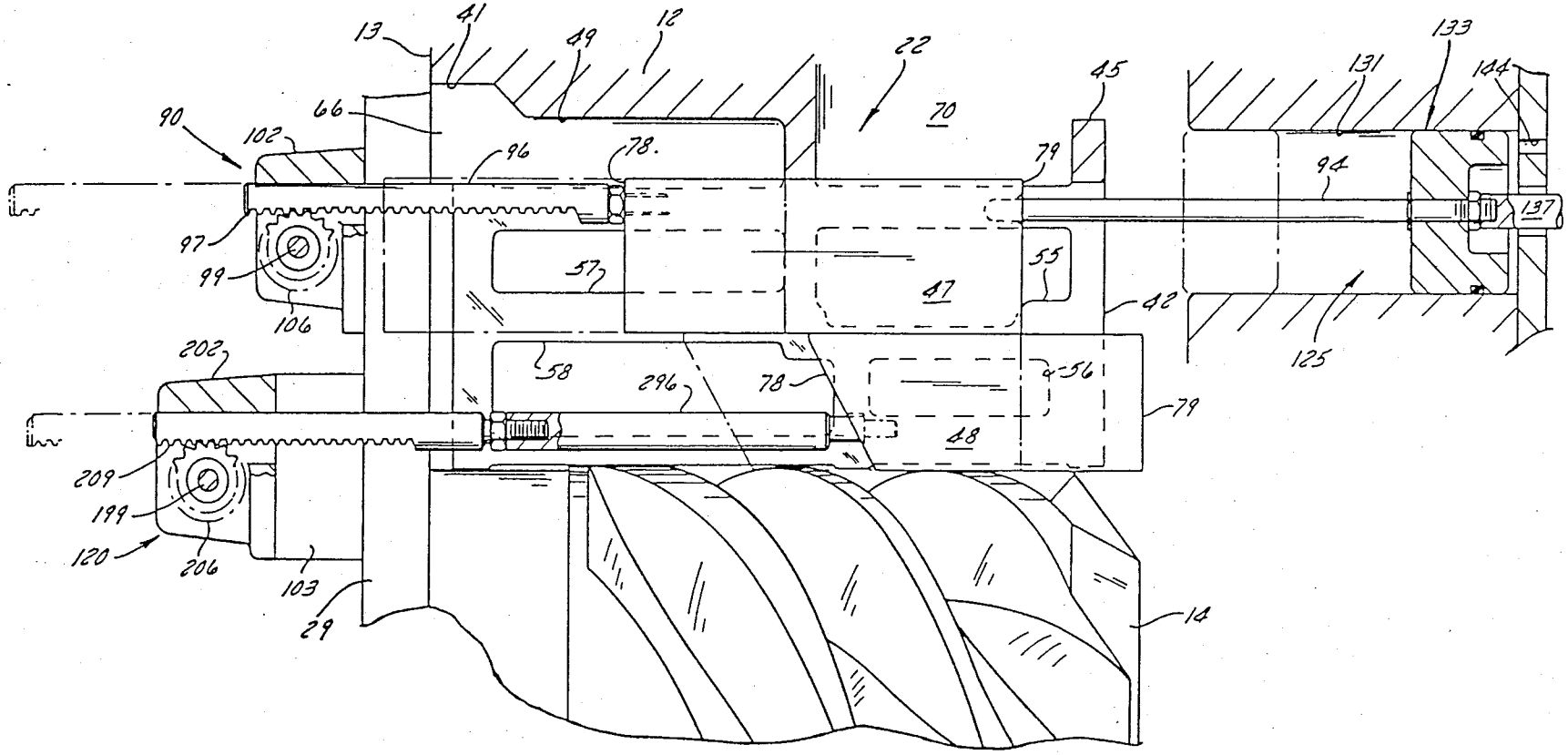
Figure 7A:
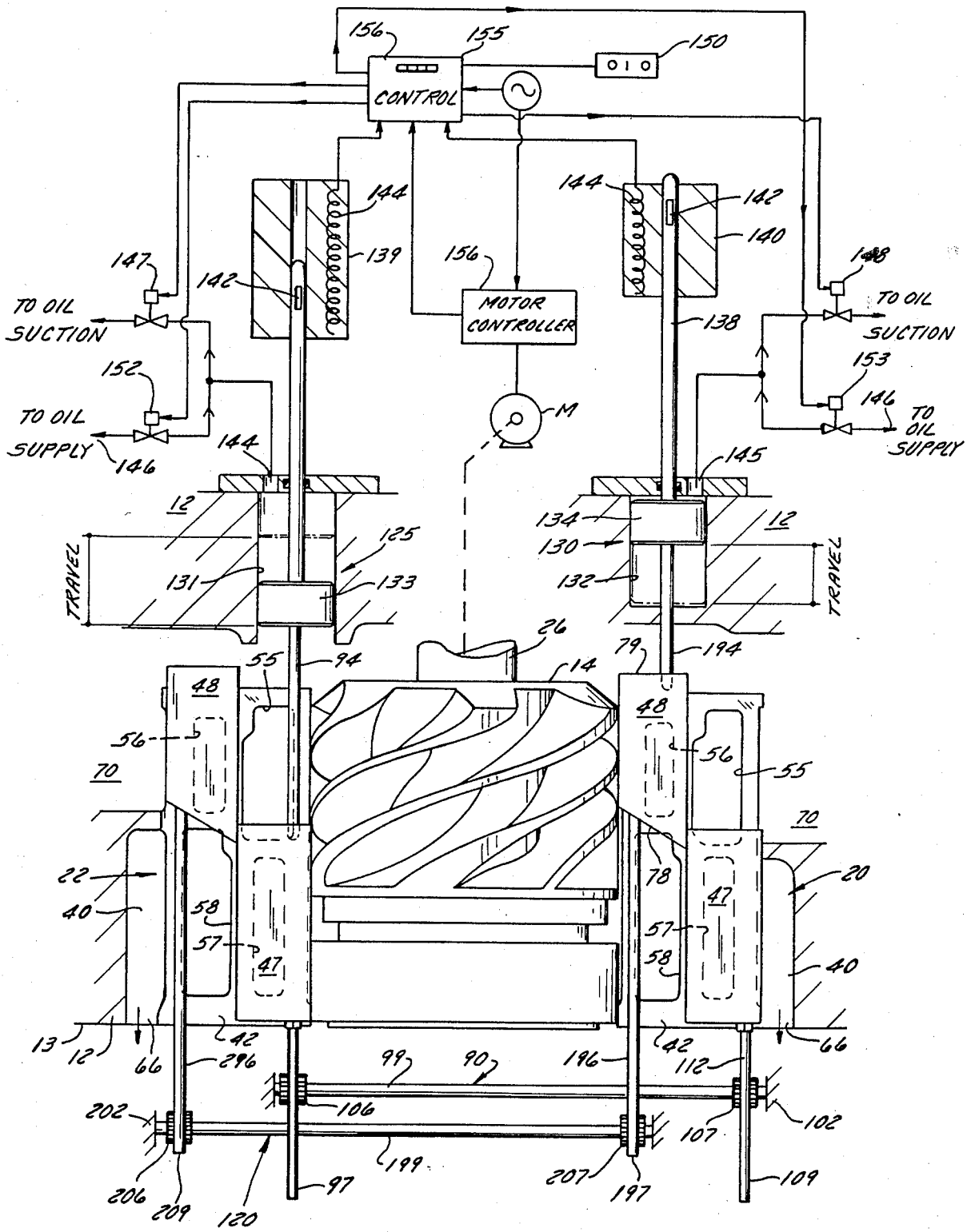
Figure 7B:
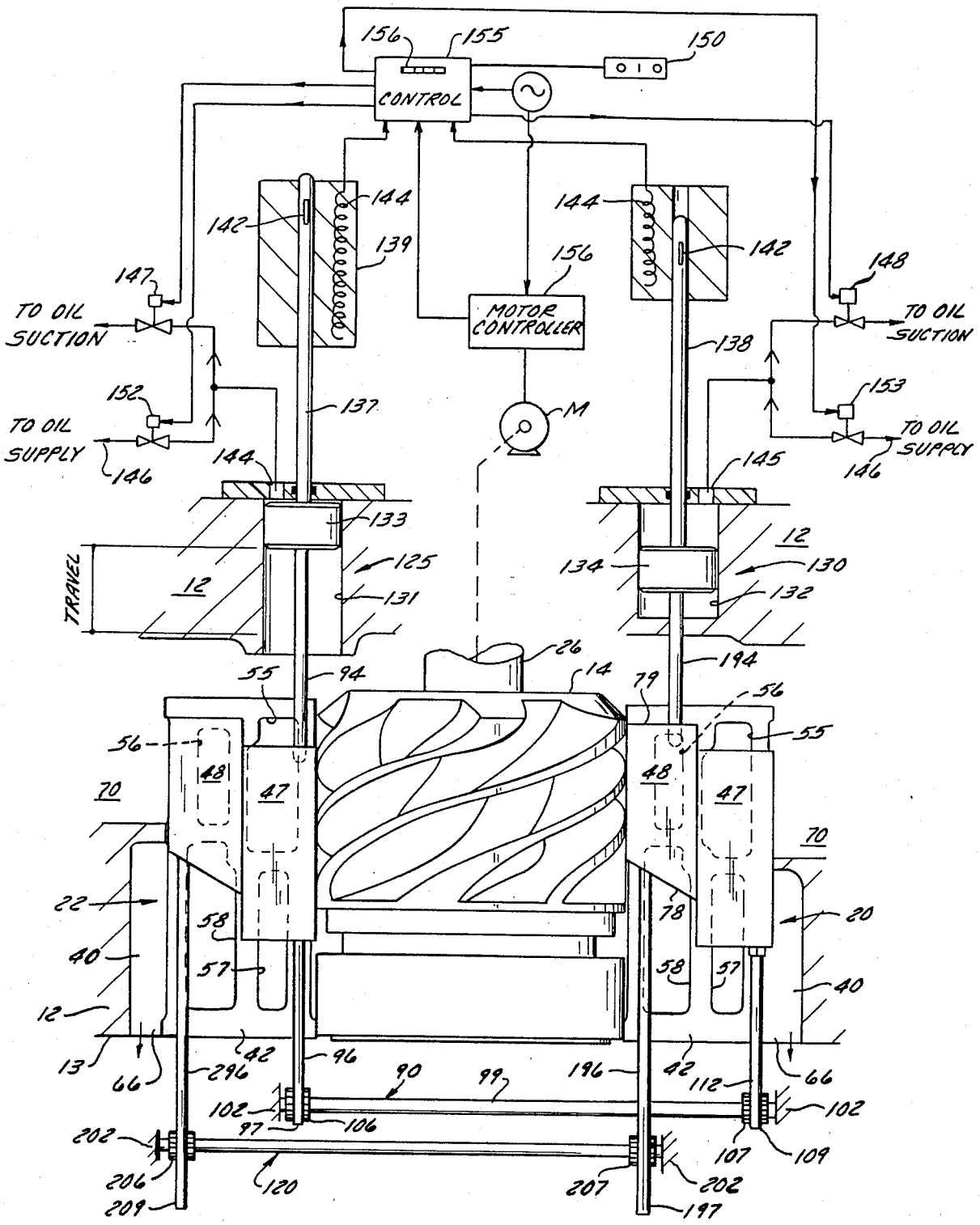
Figure 9:
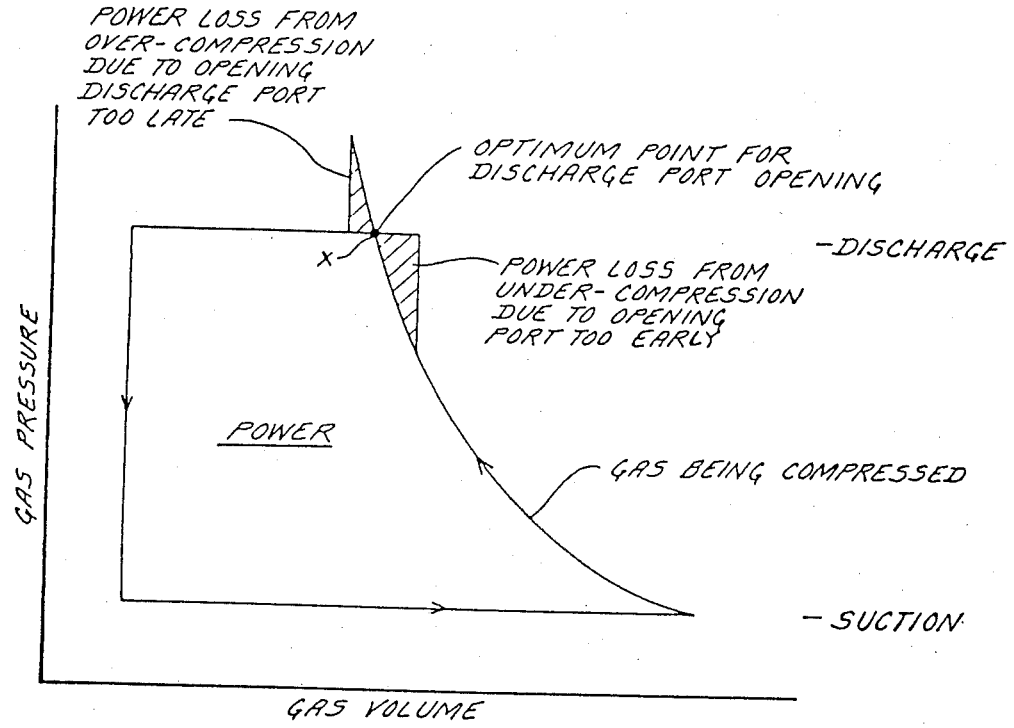
Figure 8:
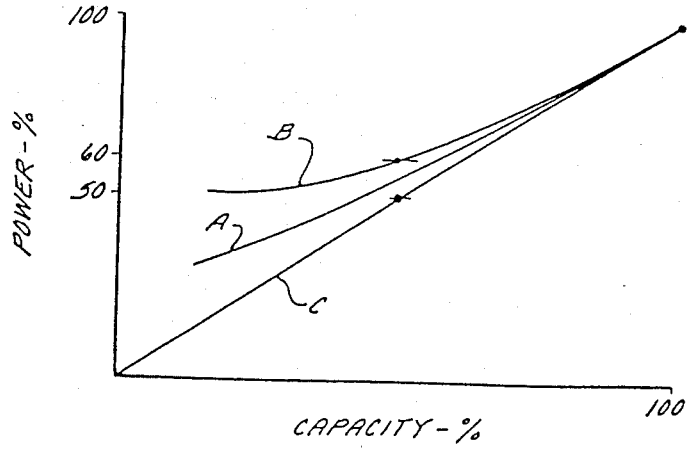

FIG. 5 (which is viewed from the discharge end of the compressor) is an exploded perspective view of one set of slide valves and a portion of the control means therefor;

FIG. 6 is an elevation view, partly in section, taken on line 6—6 of FIG. 2 and showing one set of dual slide valves and the single screw rotor separated, as by unfolding along line 6—6, to disclose interior details;

FIG. 7A is a top plan view of the compressor shown in FIGS. 1 and 2 and showing a schematic diagram of the control means employed therewith maintaining the dual slide valves in compressor start-up position;

FIG. 7B is a view similar to FIG. 7A but showing the dual slide valves being maintained in a typical compressor running position;

FIG. 8 is a graph showing the relationship between compressor power consumption and compressor capacity in a compressor in accordance with the invention; and FIG. 9 is a graph showing a typical pressure-volume diagram for a compressor of the type disclosed herein.

DESCRIPTION OF A PREFERRED EMBODIMENT

Referring to FIGS. 1 and 2, numeral 10 designates a rotary screw gas compressor 10 adapted for use in a refrigeration system (not shown) or the like. Compressor 10 generally comprises a compressor housing 12, a single main rotor 14 mounted for rotation in housing 12 and driven by means of an electric motor M (FIGS. 7A and 7B), a pair of star-shaped gate or star rotors 16 and 18 mounted for rotation in housing 12 and engaged with main rotor 14, and two sets of dual slide valve assemblies 20 and 22 (FIGS. 3, 7A and 7B) mounted in housing 12 and cooperable with main rotor 14 to control gas flow into and from the compression chambers on the main rotor 14. FIGS. 7A and 7B show a control system responsive to compressor operating conditions to operate the two sets of dual slide valve assemblies 20 and 22.

Compressor housing 12 includes a cylindrical bore 24 in which main rotor 14 is rotatably mounted. Bore 24 is open at 27 at the suction end of the bore and is closed by a wall 29 at the discharge end of the bore. Main rotor 14, which is generally cylindrical and has a plurality of helical grooves 25 formed therein defining compression chambers, is provided with a rotor shaft 26 which is rotatably supported at opposite ends on bearing assemblies 28 mounted on housing 12.

Compressor housing 12 includes spaces 30 therein in which the star rotors 16 and 18 are rotatably mounted and the star rotors 16 and 18 are located on opposite sides (180x apart) of main rotor 14. Each star rotor 16 and 18 has a plurality of gear teeth 32 and is provided with a rotor shaft 34 which is rotatably supported at opposite ends on bearing assemblies 34A and 34B (FIG. 2) mounted on housing 12. Each star rotor 16 and 18 rotate on an axis which is perpendicular to and spaced from the axis of rotation of main rotor 14 and its teeth 32 extend through an opening 36 communicating with bore 24. Each tooth 32 of each star rotor 16 and 18 successively engages a groove 25 in main rotor 14 as the latter is rotatably driven by motor M and, in cooperation with the wall of bore 24 and its end wall 29, defines a gas compression chamber.

The two sets of dual slide valve assemblies 20 and 22 are located on opposite sides (180x apart) of main rotor 14 and are arranged so that they are above and below (with respect to FIG. 2) their associated star rotors 16 and 18, respectively. Since the assemblies 20 and 22 are identical to each other, except as to location and the fact that they are mirror images of each other, only assembly 20 is hereinafter described in detail.

Figure 4:
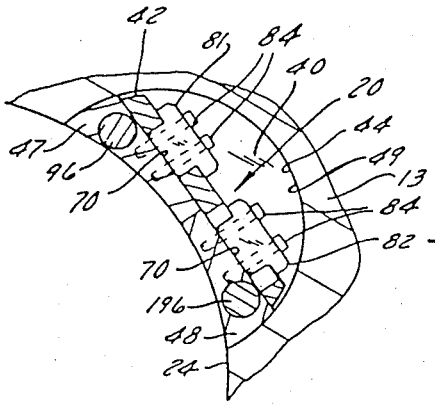
FIG. 4 is an enlarged cross-section view of one set of dual slide valves taken on line 4—4 of FIG. 1 and showing the reciprocating rods of the control means which move the slide valves.

As FIGS. 2, 4, 5 (which is viewed from the discharge end of the compressor), 6, 7A and 7B show, dual slide valve assembly 20 is located in an opening 40 which is formed in a housing wall 13 of housing 12 defining cylindrical bore 24. Opening 40 extends for the length of bore 24 and is open at both ends. As FIG. 5 shows, opening 40 is bounded along one edge by a member 44A (see FIG. 2, also), a smooth surface 44 and has a curved crosssectional configuration. Opening 40 is further bounded on its inside by two axially spaced apart curved lands 45 and 49. The space between the lands 45 and 49 is a gas inlet passage 70. Opening 40 is provided with chamfered or relieved portion 41 (see FIGS. 5 and 6) at its discharge end which defines a gas port as hereinafter explained. Assembly 20 comprises a slide valve carriage 42 which is rigidly mounted in opening 40 by three mounting screws 46 (see FIG. 5) and further comprises two movable slide valve members, namely, a suction slide valve member 47 (the uppermost member of assembly 20 in FIGS. 2, 4, 5 and 6) and a discharge slide valve member 48, which are slidably mounted on carriage 42 for movement in directions parallel to the axis of main rotor 14.

More specifically, referring to FIG. 5, carriage 42 comprises a rectangular plate portion 52 having a flat smooth front side 53 and having four openings 55, 56, 57 and 58 extending therethrough. Three spaced apart semi-circular projections 60, 61 and 62 extend from the rear side 64 of plate portion 52 of carriage 42. Projection 60 mates with curved surface 44 and with curved land 45 bounding opening 40 and is secured thereto by one mounting screw 46. Projection 61 mates with curved surface 44 and with curved land 49 bounding opening 40 and is secured thereto by the second mounting screw 46. Such mating defines a space which is a continuation of gas inlet passage 70. Projection 62 mates with curved surface 44 bounding opening 40, but projection 62 does not mate with land 49 (although third screw 46 attaches thereto) because chamfered portion 41 provides a gas exhaust passage 66 (see FIGS. 7A and 7B). Thus, the two openings 55 and 56 in carriage 42 are in direct communication with gas inlet passage 70. The other two openings 57 and 58 in carriage 42 are in direct communication with gas exhaust passage 66.

The slide valve members 47 and 48 each take the form of a block having a flat smooth rear surface 70, a curved smooth front surface 72, a flat smooth inside edge 74, a curved smooth outside edge 76, and end edges 78 and 79. End edges 79 are both straight. End edge 78 of suction slide valve member 47 is straight. End edge 78 of the discharge slide valve member 48 is slanted. As FIGS. 2 and 4 show, rear surface 70 confronts and slides upon front side 53 of plate portion 52 of carriage 42. Front surface 72 confronts the cylindrical surface of main rotor 14. The inside edges 74 of the slide valve members 47 and 48 slidably engage each other. The outside edges 76 of the slide valve members confront and slidably engage the curved surfaces 44 adjacent opening 40 in bore 24. The slide valve members 47 and 48 are slidably secured to carriage 42 by clamping members 81 and 82, respectively, which are secured to the slide valve members by screws 84 (see FIGS. 2 and 4). The clamping members 81 and 82 have shank portions 85 and 86, respectively, which extend through the openings 56 and 57, respectively, in carriage 42 and abut the rear surfaces 70 of the slide valve members 47 and 48, respectively. The screws 84 extend through holes 83 (FIG. 2) in the clamping members 81 and 82 and screw into threaded holes 87 in the rear of the slide valve members 47 and 48. The clamping members 81 and 82 have heads or flanges 89 which engage the rear side 64 of plate portion 52 of carriage 42.

Figure 3:
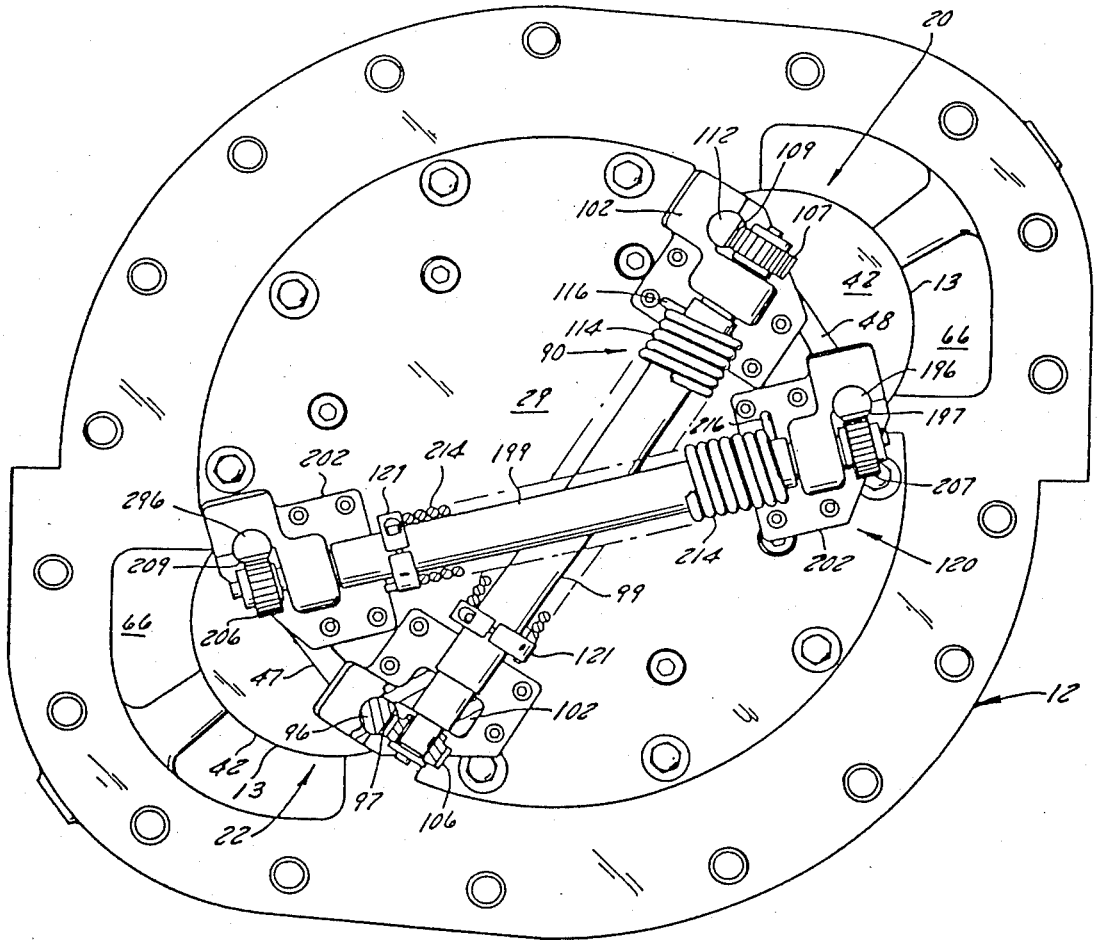
FIG. 3 is an end elevation view taken on line 3—3 of FIG. 1 and showing mechanical connection means between the two sets of dual slide valves.

As FIGS. 3, 5, 7A and 7B show, means, such as a connector assembly 120, is provided to connect together the discharge slide valve members 48 of the two dual slide valve assemblies 20 (right side of FIGS. 3, 7A and 7B) and 22 (left side of FIGS. 3, 7A and 7B) so that they move in unison with each other when slid to appropriate positions in response to axial movement (extension and retraction) of a control rod 194 which is part of the control system hereinafter described. Thus, referring to FIG. 5, control rod 194 has one end rigidly secured to a piston 134 and its other end to end edge 79 of discharge slide valve member 48. Another rod 196, which has rack teeth 197 along one side thereof, is rigidly secured at one end to the slanted other end edge 78 of discharge slide valve member 48. Referring to FIG. 3, a rotatable rod 199 is rotatably mounted on a pair of rod support brackets 202 which are rigidly secured to support plate 29 which is bolted to the housing 12. Rotatable rod 199 has pinion gears 206 and 207 rigidly secured thereto at its opposite ends. Pinion gear 206 is engaged with the rack teeth 209 on a rod 296 which is connected to the other discharge valve member 48. A helical torsion spring 214 is disposed on rotatable rod 199 and operates to bias both of the discharge slide valve members 48 against the action of control rod 194 to ensure proper positioning of the valve members 48 during extend-retract motions of the control rod. One end of torsion spring 214 is anchored as at 216 to rod support bracket 202. The other end of torsion spring 214 is anchored as by a clamp 121 to rotatable rod 199. Thus, as rod 199 is rotated in one direction by the control rod 194, the torsion spring 214 loads up to exert a bias tending to rotate rod 199 in the opposite direction.

As is apparent, a connector assembly designated 90 and similar to the connector assembly 120 hereinbefore described is provided to connect together the suction slide valve members 47 of the two dual slide valve assemblies 20 and 22 so that discharge slide valve members 47 move in unison with each other when slid to appropriate positions. Referring initially to the left side of FIGS. 7A and 7B, the connector assembly 90 comprises a control rod 94 connected to piston 133 and to suction slide valve member 47 of assembly 22, a rack rod 96 connected to a suction member 47 and having rack teeth 97, a rotatable rod 99 having pinion gears 106 and 107 thereon, a pair of rod support brackets 102, a rod 112 connected to a slide member 47 and having rack teeth 109 thereon, and a tension spring 114. Pinion gear 107 engages rack teeth 109 on the side of slide rod 112 which has one end rigidly secured to the end edge 78 of the suction slide valve member 47 of the slide valve assembly 20.

Referring to FIGS. 5, 6, 7A and 7B, the control system for effecting movement of the slide valve members 47 (suction) and 48 (discharge) is seen to comprise two actuators 125 (suction) and 130 (discharge) operable to effect movement of both of the suction slide valve members 47 and independent movement of both of the discharge slide valve members 48, respectively. The actuators 125 and 130 take the form of hydraulic actuators comprising cylinders 131 and 132, respectively, formed in the compressor housing 12 and containing pistons 133 and 134, respectively, slidably mounted therein. The pistons 133 and 134 are connected on one side thereof to ends of the aforementioned control rods 94 and 194, respectively. The pistons 133 and 134 are connected on the other side thereof to the ends of sensor rods 137 and 138, respectively, which provide electrical signals indicative of the locations of the slide valve members 47 and 48, respectively, and thus reflect or indicate certain compressor conditions, as hereinafter explained. The pistons 133 and 134 move in response to hydraulic fluid (oil) supplied through fluid ports 144 and 145, respectively, from a fluid source 146 through solenoid valves 152 and 153, respectively, or returned to the source 146 through solenoid valves 147 and 148, respectively. The solenoid valves 152, 153 and 147, 148 are controlled by electric input signals from a motor controller 156 for motor M and from the sensing devices 139 and 140, as hereinafter explained.

In operation, the two suction valve members 47 move in unison with each other, and the two discharge slide valve members 48 move in unison with each other. Each suction slide valve member 47 is slidably positionable (between full load and part load positions) relative to suction port 55 to control where low pressure uncompressed refrigerant gas from gas inlet passage 70 is admitted to the compression chambers or grooves 25 of main rotor 14 to thereby function as a suction by-pass to control compressor capacity. Each discharge slide valve member 48 is slidably positionable (between minimum and adjusted volume ratio positions) relative to discharge port 58 to control where, along the compression chambers or grooves 25, high pressure compressed refrigerant gas is expelled from the compression chambers 25, through discharge port 58 to gas exhaust passage 66 to thereby control the input power to the compressor. The slide valve members 47 and 48 are independently movable by the separate pistoncylinder type hydraulic actuators 125 and 130, respectively. The control means operates to position the slide valves 47 and 48 for compressor start-up, as hereinafter explained. The control means or system is also responsive, while the compressor is running, to compressor capacity and to power input, which is related to the location of the slide valves 47 and 48, and operates the actuators to position the slide valve members 47 and 48 to cause the compressor to operate at a predetermined capacity and a predetermined power input. The slide valves 47 are capable of adjusting the capacity between about 100% and about 10%. The slide valves 48 are capable of adjusting the discharge condition so that power required by the compressor to maintain the desired capacity is at a minimum. The control system includes sensing devices 139 and 140 to detect the position of the slide valve members 47 and 48, respectively.

Preferably, as FIGS. 7A and 7B show, the sensing devices 139 and 140 each take the form of a commercially available device, such as a linearly variable differential transformer (LVDT), in which a movable core 142, which is axially moved by its respective sensor rod 137 and 138, affects the electrical output signal from a stationary induction coil 144 and thus provides an electrical output signal to controller 155 indicative of the position of the respective slide valves 47 and 48. Although a rheostat (not shown) could be employed instead of an LVDT, the former is subject to wear and break-down because of its frictionally engaging components, whereas the LVDT exhibits little wear and relies on proximity and position of the components 142 and 144 for operation. The output signals are converted by the controller 155 into electrical control signals which operate the solenoid valves 153 and 152 (and 148 and 147) and thus meter hydraulic fluid flow to operate the actuators 130 and 125, respectively, to properly locate the slide valves 48 and 47 at desired locations. These locations are initially selected by providing manual input signals from a switch panel 150 by the person responsible for compressor operation. Controller 155 includes read-out means 156 to indicate the selected and actual operating conditions.

If preferred, instead of electrical or electronic sensors such as 139 and 140, the positions of the slide valves 47 and 48 could be ascertained by detecting pressure conditions at selected points in the compressor 10 by means of suitable pressure sensing devices (not shown) and the signals therefrom could be converted to electrical signals for operating the actuators 125 and 130.

Or, the compressor gases themselves at various points in the system, could be used directly to effect positioning of the slide valves 47 and 48, if suitable structures (not shown) are provided.

FIG. 6 shows the range of positions that slide valves 47 and 48, respectively, are capable of assuming with respect to ports 55, 57 and ports 56, 58, respectively, and with respect to housing 12 and main rotor 14. More specifically, referring to FIG. 6, suction slide valve 47 is movable between the position shown in solid lines (wherein it is in fully closed position and maintains suction port 55 substantially fully closed) and the position shown in phantom (dashed) lines (wherein it is in fully open position and maintains suction port 55 fully open). FIG. 6 also shows that discharge slide valve 48 is movable between the position shown in solid lines (wherein it is in fully open or minimum volume position and maintains discharge port 58 fully open) and the position shown in phantom (dashed) lines (wherein it is in closed or maximum volume position and maintains discharge port 58 partially closed).

As will be understood, when compressor 10 is being operated (i.e., running at normal speed) at its maximum capacity, it is said to be "fully loaded", and suction slide valve 47 assumes its fully closed position shown whereby suction port 55 is fully closed, whereas discharge slide valve 48 assumes a position whereby the compressor operates at optimal volume ratio and efficiency and discharge port 58 is partially closed. Furthermore, when compressor 10 is being operated (i.e., running at normal speed) at its minimum capacity, it is said to be "fully unloaded", and suction slide valve 47 assumes its fully open position whereby suction port 55 is fully open, whereas discharge slide valve 48 assumes its closed or minimum volume position whereby discharge port 58 is fully closed. When the compressor is operating in some condition between fully unloaded and fully loaded conditions, the valves 47 and 48 can assume appropriate positions between their extreme positions to provide operation at the ideal volume ratio and thus optimum efficiency.

Referring now to FIGS. 7A and 7B, the method will now be described for operating independently movable suction slide valve 47 and discharge slide valve 48 to prevent undesirable, possibly damaging hydraulic pressure build-up caused by sealing oil remaining in the gas compression chambers during compressor start-up. Referring to FIG. 7A, while compressor 10 is started and brought up to full speed, suction slide valve 47 is disposed by the control means in its fully open or unloaded position to fully open gas suction port 55 and discharge slide valve 48 is disposed by the control means in its minimum volume position to fully open gas discharge port 58 to enable excess oil in the gas compression chambers to exit freely through compressor gas discharge port 58 (and through gas exhaust passage 66) before oil pressure build-up can occur. Referring to FIG. 7B, when compressor 10 is at full speed, suction slide valve 47 is positioned by the control means to maintain a desired gas suction pressure and discharge slide valve 48 is positioned by the control means to equalize gas pressure between the gas compression chambers and compressor gas discharge ports 58. More specifically, when compressor 10 is up to speed, suction slide valve 47 can remain in fully unloaded position wherein suction slide valve 47 maintains suction port 55 fully open or can be moved to some intermediate position (FIG. 7B) wherein suction port 55 is only partially open, depending on instructions from the control means. The control means will then cause discharge slide valve 48 to move from its minimum volume position wherein discharge port 58 is fully open (FIG. 7A) to some appropriate intermediate position (FIG. 7B), depending on operating conditions to maintain optimum efficiency. On shut-down of compressor 10, both slide valves are returned to their start-up positions shown in FIG. 7A.

As will be understood, during normal running operation of the compressor, the gas pressure at the discharge port of a compressor tends to vary substantially in response to variations in ambient temperatures resulting from seasonal or environmental temperature changes. Referring to the pressure-volume diagram in FIG. 9, if not corrected, the gas may be over-compressed in some situations, as when the discharge port opens late with respect to an optimum opening point X, and this results in overcompression and extra work for the compressor, with resultant undesirable waste of electrical input power needed for operating the compressor because the gas is trapped in the rotor grooves for a longer period of time and its volume is reduced as its pressure is increased, i.e., the volume ratio is increased. Conversely, when the discharge port opens early with respect to optimum point X, there is also a power loss because the volume ratio (i.e., the ratio of inlet gas volume to outlet gas volume) is lowered, i.e., the internal cylinder pressure at the point of discharge is lowered, thereby causing the compressor volume ratio to decrease. The two discharge slide valves 48 in accordance with the invention are movably positionable to adjust the location at which the discharge ports 58 open; the preferred location being that point X in FIG. 9 at which internal gas pressure in the compression chambers on the rotor equals the condensing pressure in the refrigeration system in which the compressor is employed.

The line A in the graph in FIG. 8 shows the relationship between compressor capacity (expressed in percentage) and compressor power (expressed in percentage) which is achieved by the slide valve members 47 and 48 and the control means therefor in accordance with the present invention, as compared to the line B which shows a typical relationship found in prior art compressors. Line C shows the theoretical optimum relationship.

Means are provided in the present invention to establish the start-up positions of the slide valves 47 and 48, to relocate them in desired positions suitable for the load condition desired when the compressor is up to speed, and to determine the positions for the slide valves 47 and 48 which would provide the most efficient volume ratio for the selected load condition. These means could, for example, take the form of a microprocessor circuit (not shown) in the controller which mathematically calculates these slide valve positions, or these means could take the form of pressure sensing devices, such as are disclosed in the preferred embodiment herein. As disclosed herein, means are employed to sense these two (inlet and outlet) pressure conditions and to shift the slide valve 48 axially in the proper direction for the proper distance until the equalization location (point X in FIG. 9) is reached. The present invention enables equalization to be accomplished at part-load, as well as full-load, conditions because of the independently movable dual slide valves 47 and 48.

It should also be noted that in the preferred embodiment disclosed herein the two valve members 47 (on opposite sides of the rotor) are moved in synchronism with each other and the two valve members 48 (on opposite sides of the rotor) are moved in synchronism with each other so as to provide for "symmetric" unloading of the compressor. However, each slide valve member in a pair can be moved independently of the other so as to provide for "asymmetrical" unloading of the compressor, if appropriate linkages (not shown) are provided and if the control system is modified accordingly in a suitable manner.

When the compressor operates at low capacity, inefficiency results and power losses increase substantially. Half of such inefficiency would be attributable to losses on one side of the rotor. Therefore, the advantages of such independent valve member movement as above-described is that, when the compressor is unloaded to a point where, for example, about 50% of total compressor capacity is reached, it would then be possible to effectively "shut off" one side of the compressor and eliminate all losses associated with the "shut off" side of the compressor. Although this might result in some radial load imbalance on the rotor, this could be acceptable under some circumstances, or provisions could be made to compensate for such imbalance.

It should be further noted that, when both slide valves 47 and 48 are moved to the open positions shown in FIG. 7A for start-up, neither gas nor oil is trapped or compressed in the compression chambers.

We claim:

1. A method for operating a rotary screw type gas compressor and control means therefor to prevent undesirable compression of oil in the gas compression chambers during compressor start-up, said compressor comprising a housing having a cylindrical bore therein, a motor-driven helically grooved single main rotor mounted for rotation in said bore, and a pair of star-shaped gate rotors rotatably mounted in said housing and engageable with said grooves in said main rotor to define a plurality of compression chambers, one chamber at each groove, said compressor further comprising a suction port (55) in said housing and confronting said main rotor to admit low pressure uncompressed gas to said compression chambers and a discharge port (58) in said housing and confronting said main rotor to release high pressure compressed gas from said compression chambers, said compressor also comprising slide valve members (47, 48) for regulating both compressor capacity and compressor power input, one being a suction slide valve member (47) which is slidably positionable to control the extent to which said suction port (55) is open to thereby function as a suction by-pass to control compressor capacity, the other being a discharge slide valve member (48) which is independently slidably positionable to control the position at which said discharge port (58) is open to thereby control the volume ratio and thereby the input power to the compressor, said slide valve members (47, 48) being disposed in side-by-side sliding relationship in a recess in said housing, which recess extends alongside and is in communication with said cylindrical bore, and each slide valve member (47, 48) having a face which is complementary to and confronts the main rotor surface in sliding sealed relationship, said slide valve members (47, 48) being movable independently of each other by said control means, said control means including a separate actuator for each slide valve member (47, 48) and sensing means, said control means being operable to position the slide valve members for compressor start-up, said control means also being responsive to the capacity of the compressor and to the volume ratio while the compressor is running to operate the actuators to appropriately position the slide valve members and thereby enable the compressor to operate at a predetermined capacity and a predetermined volume ratio;

said method comprising the steps of:

during start-up of said compressor (10), operating said control means to move and maintain both of said slide valves (47, 48) in positions wherein both of said ports (55, 58) are open to enable oil in said gas compression chambers to exit through said gas discharge port (58) without build-up of excessive, possibly damaging hydraulic pressure;

and, when said compressor (10) is up to full speed, operating said control means to position said suction slide valve (47) to maintain a desired gas suction pressure at said gas suction port (55) or in said gas compression chambers and operating said control means in response to said sensing means to position said discharge slide valve (48) to equalize gas pressure between said gas compression chambers and said gas discharge port (58).

2. A method according to claim 1 comprising the further step on shut-down of the compressor (10) of operating said control means to return both of said slide valves (47, 48) to positions wherein both of said ports (55, 58) are open.

3. A method for operating a rotary screw type gas compressor and control means therefor to prevent undesirable compression of oil in the gas compression chambers during compressor start-up, said compressor comprising a housing having a cylindrical bore therein, a motor-driven helically grooved single main rotor mounted for rotation in said bore, and a pair of star-shaped gate rotors rotatably mounted in said housing and engageable with said grooves in said main rotor to define a plurality of compression chambers, one chamber at each groove, said compressor further comprising a suction port (55) in said housing and confronting said main rotor to admit low pressure uncompressed gas to said compression chambers and a discharge port (58) in said housing and confronting said main rotor to release high pressure compressed gas from said compression chambers, said compressor also comprising slide valve members (47, 48) for regulating both compressor capacity and compressor power input, one being a suction slide valve member (47) which is slidably positionable to control the extent to which said suction port (55) is open to thereby function as a suction by-pass to control compressor capacity, the other being a discharge slide valve member (48) which is independently slidably positionable to control the position at which said discharge port (58) is open to threby control the volume ratio and thereby the input power to the compressor, said slide valve members (47, 48) being disposed in side-by-side sliding relationship in a recess in said housing, which recess extends alongside and is in communication with said cylindrical bore, and each slide valve member (47, 48) having a face which is complementary to and confronts the main rotor surface in sliding sealed relationship, said slide valve members (47, 48) being movable independently of each other by said control means, said control means including a separate actuator for each slide valve member (47, 48) and sensing means, said control means being operable to position the slide valve members for compressor start-up, said control means also being responsive to the capacity of the compressor and to the volume ratio while the compressor is running to operate the actuators to appropriately position the slide valve members and thereby enable the compressor to operate at a predetermined capacity and a predetermined volume ratio;

each of said dual slide valves (47, 48) being movable independently of the other between two extremes positions and to intermediate positions therebetween, said method comprising the steps of:

operating said control means to dispose said suction slide valve (47) in one of its extreme positions so that said suction port (55) is fully open and operating said control means to dispose said discharge slide valve (48) in one of its extreme positions so that said discharge port (58) is fully open while said compressor (10) is being started;

operating said control means to move said suction slide valve (47) from its said one extreme position to a predetermined position, including any of its intermediate positions and its other extreme position, to maintain a predetermined suction pressure at said gas suction port (55) or in said gas compression chambers while said compressor (10) is operating at normal speed;

operating said control means in response to said sensing means to move said discharge slide valve (48) from its said one extreme position to a position, including any of its intermediate positions and its other extreme position, whereat fluid pressure at said discharge port (58) is equal to the fluid pressure in said compression chambers, while said compressor (10) is operating at normal speed;

and operating said control means to dispose said suction slide valve (47) in its said one extreme position and to dispose said discharge slide valve (48) in its said one extreme position, while said compressor is being stopped.

* * * * *